United States Patent [19]

Schoeffler

[11] Patent Number: 4,577,614

[45] Date of Patent: Mar. 25, 1986

[54] ADVANCED QUICK BALL RELEASE SUB

[76] Inventor: William N. Schoeffler, P.O. Box 91105, Lafayette, La. 70509

[21] Appl. No.: 490,555

[22] Filed: May 2, 1983

[51] Int. Cl.[4] ..... E21B 21/08

[52] U.S. Cl. ..... 125/25; 175/218

[58] Field of Search ..... 175/25, 218, 318; 166/84, 65 R; 137/68 R

[56] References Cited

U.S. PATENT DOCUMENTS

| | | | |
|---|---|---|---|
| 873,661 | 12/1907 | Brooks | 175/218 |
| 873,669 | 12/1907 | Johnston | 175/218 |
| 2,079,922 | 5/1937 | Owen | 166/84 |
| 2,563,155 | 8/1951 | Cardwell | 166/84 |
| 3,815,925 | 6/1974 | Mattoon | 166/84 |
| 4,088,298 | 5/1978 | Brown | 137/68 R |
| 4,099,562 | 7/1978 | Mattoon | 166/84 |
| 4,109,713 | 8/1978 | Clow | 166/84 |
| 4,367,794 | 1/1983 | Bednar et al. | 166/65 R |

*Primary Examiner*—James A. Leppink
*Assistant Examiner*—William P. Neuder
*Attorney, Agent, or Firm*—Keaty & Keaty

[57] ABSTRACT

A quick-ball release blowout preventer apparatus is mounted above a kelly for preventing oil and gas blowouts. A longitudinally bored subassembly is provided with at least one transverse bore therethrough for securably receiving a quick-ball release bolt mechanism. The longitudinal bore of the subassembly is aligned with the bores of the kelly cock and the kelly, thereby providing a fluid flow passage therethrough. An activator mechanism and a spring-loaded plunger mechanism is provided. The activator mechanism activates the spring-loaded plunger which in turn moves the ball valve to allow fluid flow through slots provided in the valve seat.

4 Claims, 8 Drawing Figures

ADVANCED QUICK BALL RELEASE SUB

BACKGROUND OF THE INVENTION

The present invention is in the field of blowout preventor assemblies for preventing the upward flow of excessive gas (or any other) pressure from a subterranean source during the drilling or production of an oil or gas well. Also, the present invention features a device which is in the field of oil well fishing or article retrieval apparatus, in an alternative embodiment thereof.

In many instances, oil and/or gas wells develop extreme pressure, or for some other reason, control valves and other structures at the surface of the oil rig are destroyed or damaged resulting in uncontrollable loss of well fluid, and in some instances, the flowing fluids are ignited and the well burns out of control. Many proposals have been made heretofore for capping or shutting off flow from such blownout or burning wells but none have proven completely successful. It has been proposed to clamp a multipart housing around a well casing above the ground surface and by means of devices within the housing to collapse and flatten the casing at some point therein to shut off flow from the well and then to perforate the casing below the closure and withdraw well fluids from the housing. Such a proposal is shown in U.S. Pat. No. 1,949,672. Another proposal has been to bolt or otherwise secure a multipart housing around a well casing and shearing knives within the housing are operated by hydraulic means or otherwise to shear through the casing within the housing, the shearing knives themselves then serving as a gate valve to close the well. Such a proposal is shown in U.S. Pat. No. 1,875,673. Such proposals, however, have not been successful since the shearing knives do not make a smooth cut and a satisfactory seal between the knives and casing has not been achieved. Other proposals for closing blownout or burning wells involve the provision as a permanent part of the well casing, certain valve-like devices for shutting off flow.

SUMMARY OF THE INVENTION

The present invention relates to a device comprising a longitudinally bored subassembly (i.e. thick-walled pipe) having at least one transverse bore provided therethrough for securably receiving a quick ball release bolt insert mechanism, which is the primary innovation of the present invention (as will be hereinafter described), wherein said subassembly is fluidly connected within the derrick of an oil rig between the kelly cock and kelly units thereof, said longitudinal bore of said subassembly being aligned with the bores of the kelly cock and the kelly, thereby providing a fluid flow passage therethrough.

The present invention generally works in the following manner:

a. When in its normal, non-operating position, a ball is retained within an internal chamber provided by said quick ball release bolt mechanism by means of extendible/retractable retainer fingers securably mounted towards the inner end of said internal chamber, wherein the inner end of said chamber directly communicates with the longitudinal bore of said subassembly. Further, a spring-loaded plunger mechanism is reciprocally mounted within said internal chamber just behind said ball, and is biased into its most retracted position (i.e. maximum tension on said spring) in the present invention's dormant or non-operating mode, by means of an external mechanism, or activator mechanism, which is preferably housed by an internally channeled collar securably engaged with said bolt insert mechanism, to thereby prevent accidental or inadvertent actuation of said plunger mechanism, as will hereinafter be clearly seen;

b. When excessive downhole gas pressure is experienced/sensed by oil rig personnel, said activator mechanism is manipulated so as to release said spring-loaded plunger mechanism into its most extended position, whereby said plunger forces said ball through said retainer fingers and into said longitudinal bore of said subassembly, wherein is securably mounted a valve seating arrangement which comprises a ball valve seat attached to a cylindrical structure which is provided with axial slots to allow the flow of drilling fluids, concrete, or any other suitable substance therethrough—the upwardly flowing downhole gas pressure forces said ball into fluidly sealing, seating engagement with said ball valve seat, thereby prohibiting the flow of said gas pressure therebeyond, thereby preventing damage to control valves and other structures which may result in uncontrollable loss of well fluid and subsequent ignition thereof, thereby preventing an oil well blowout and consequently, loss of great amounts of money and human life. After the ball has been so seated, fluids, concrete, or any other suitable substance can be injected through the kelly cock into the longitudinal bore of said subassembly and downwardly through said axial slots of said cylindrical structure which is attached to said ball valve seat, said fluids then continuing downwardly through the kelly and drill pipe fluidly connected to bottom of said kelly, and finally to the source of excessive gas pressure, until such point as the fluid pressure neutralizes or overcomes downhole gas pressure, at which juncture the threat of a blowout is substantially averted as is widely known and conventionally practiced within the oil and gas industry. Prior to the advent of the present invention, however, all ball release subs similar to that of the present invention have taught plunger mechanisms which at least partially extend outwardly from the internal chamber wherein the ball is retained, thereby requiring that an external force be applied to the plunger mechanism of sufficient magnitude to overcome the gas pressure which fills the internal chamber, due to the fact that said chamber is in direct communication with said longitudinal bore of the subassembly through which said gas pressure is travelling upwardly. However, in actual practice, it is highly impractical and sometimes impossible, depending upon what type of equipment is immediately available to oil rig personnel, to apply this magnitude of force to said plunger mechanism, thereby resulting in the failure of the entire device to achieve its designed purpose, thereby ultimately potentially resulting in a dangerous blowout situation. The device of the present invention overcomes these serious shortcomings of the prior art by providing a bolt insert mechanism having an internal chamber which communicates directly with the gas pressure passageway, and which contains the entire plunger mechanism and the ball, inter alia, thereby equalizing the pressure between the plunger mechanism and the gas pressure passageway, thereby eliminating the necessity of having to overcome the excessive gas pressure. Rather, the present invention teaches the use of an activator mechanism, to actuate the plunger mechanism, which rather than working against the pressure, works with the gas pressure and is aided by the gas pressure during the process of actuating the plunger mechanism to force the ball on seat.

Further, in an alternative embodiment, the present invention teaches a quick ball release bolt insert mechanism containing a smaller ball than the one employed in the above-described embodiment, wherein said bolt insert mechanism can be used in lieu of the one with the larger ball, or may be used in tandem therewith, to thereby provide dual function capability for the entire device. In said alternative embodiment, the internal components of said bolt insert mechanism and arrangement thereof are suitably identical to the preferred embodiment, the only difference being the size of the ball contained therein, and the application therefor. In this regard, whenever it is desired, within the context of oil well drilling operations to "fish" for "junk" in the well bore being drilled (i.e. retrieve tools, bits, bearings, excess shavings from downhole), said spring-loaded plunger mechanism is actuated by means of said activator mechanism, thereby directing said smaller ball down said longitudinal bore of said subassembly and downwardly through the bores of said kelly and said drill pipe, whereby said ball ultimately engages a retriever tool disposed therewithin at some desired point downhole, whereby said retriever tool facilitates the removal of the wanted items, which typically include broken drilling bits, excess rock shavings, etc. It is important to note that said external activator mechanism of the first and and second stated embodiments of the present invention is preferably constructed in such a manner as to prevent inadvertent actuation thereof, as will hereinafter be fully developed.

DETAILED DESCRIPTION OF PREFERRED EMBODIMENTS

Figure 1:
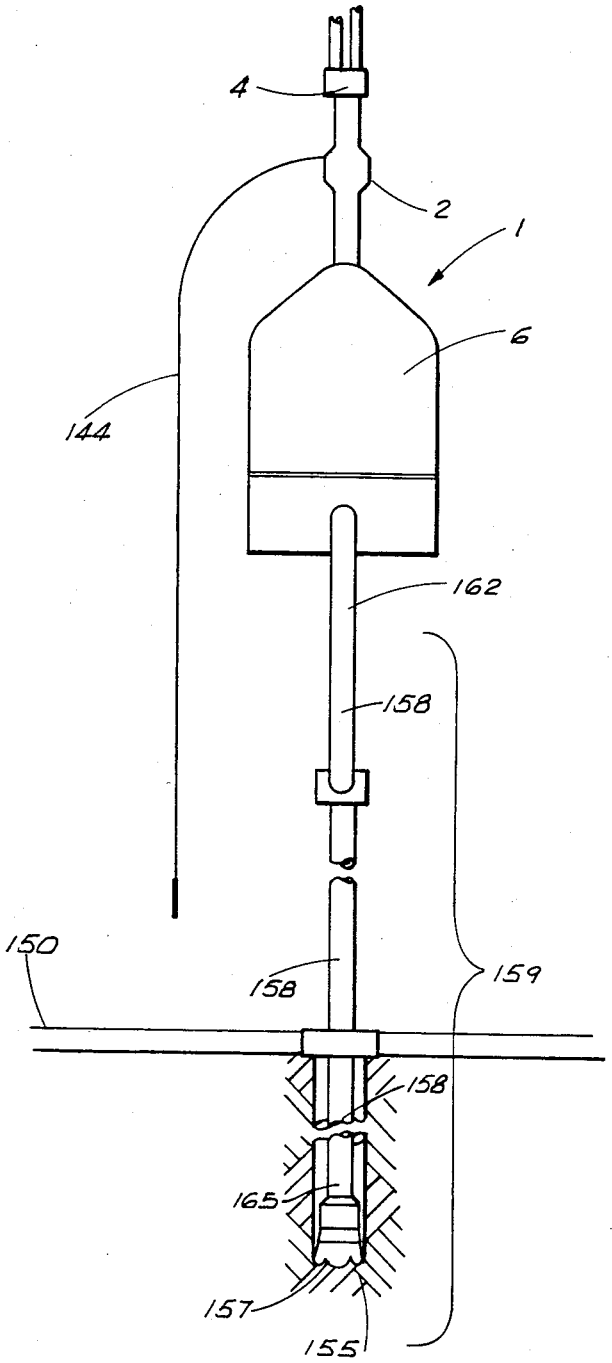
FIG. 1 is a plan view of the apparatus of the present invention mounted between a kelly cock valve and a kelly of an oil rig.

Referring now to FIG. 1, there can be seen the entire apparatus of the present invention, in plan form, as indicated generally by the numeral 1.

Figure 2:
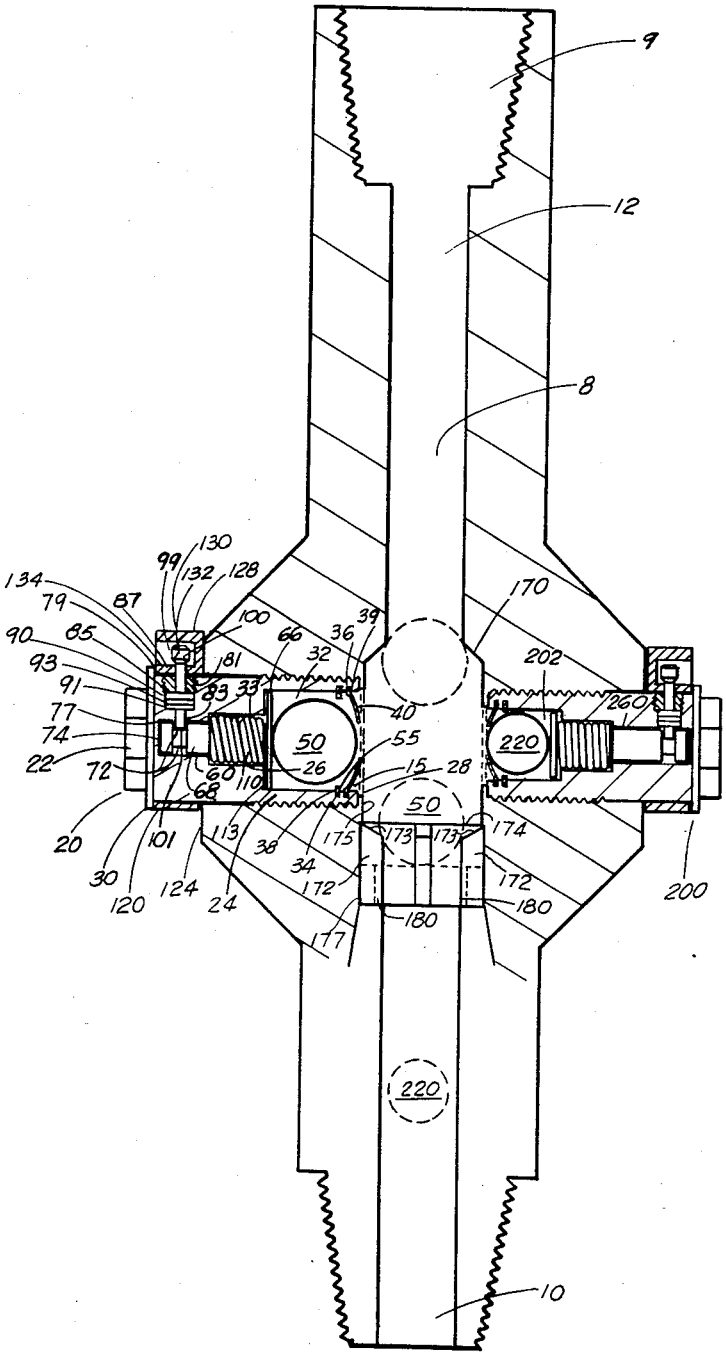
FIG. 2 is a cross sectional view of the apparatus of the present invention.

Referring to FIG. 2, there can be seen the entire apparatus of the present invention, indicated generally by the numeral 1, wherein it comprises, inter alia, a subassembly 2 fluidly connected between the kelly cock valve 4 and the kelly 6 of an oil rig (see FIG. 1 for a perspective, plan view of the present invention), preferably, longitudinal bore 8 provided through sub 2 being aligned with bores 9, 10 of kelly cock valve 4 and kelly 6, respectively, thereby providing a continuous fluid flow passage 12 for the circulation of drilling fluids, inter alia, therethrough.

Figure 3:
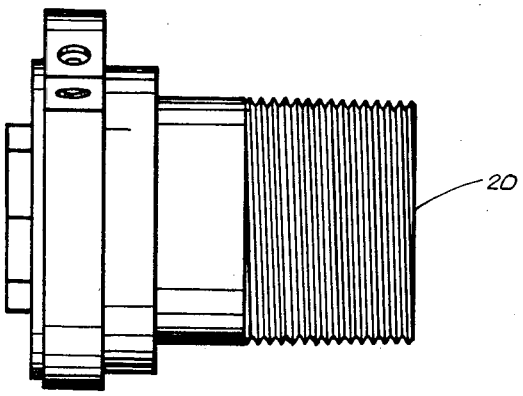
FIG. 3 is an elevational view of the quick ball release bolt insert mechanism of the apparatus of the present invention.
Figure 4:
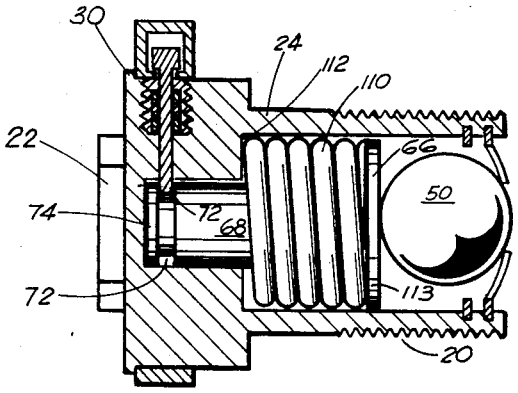
FIG. 4 is a cross-sectional view of the detail shown in FIG. 3.
Figure 5:
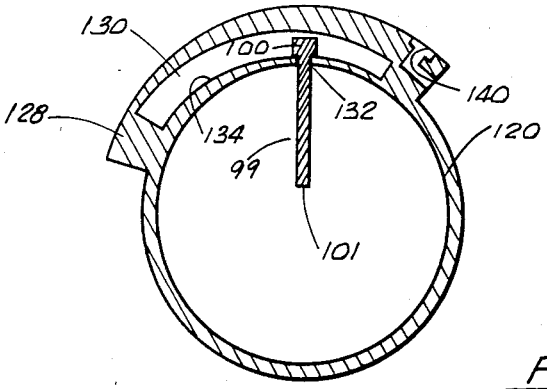
FIG. 5 is a cross-sectional view of the activator collar with the head portion of the activator pin engaged in its internal channel.
Figure 8:
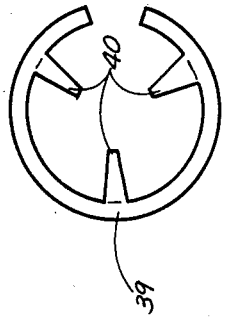
FIG. 8 is a front view of the retainer ring.
Figure 7:
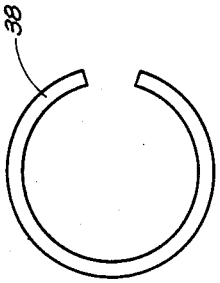
FIG. 7 is a front view of the snap-ring.
Figure 6:
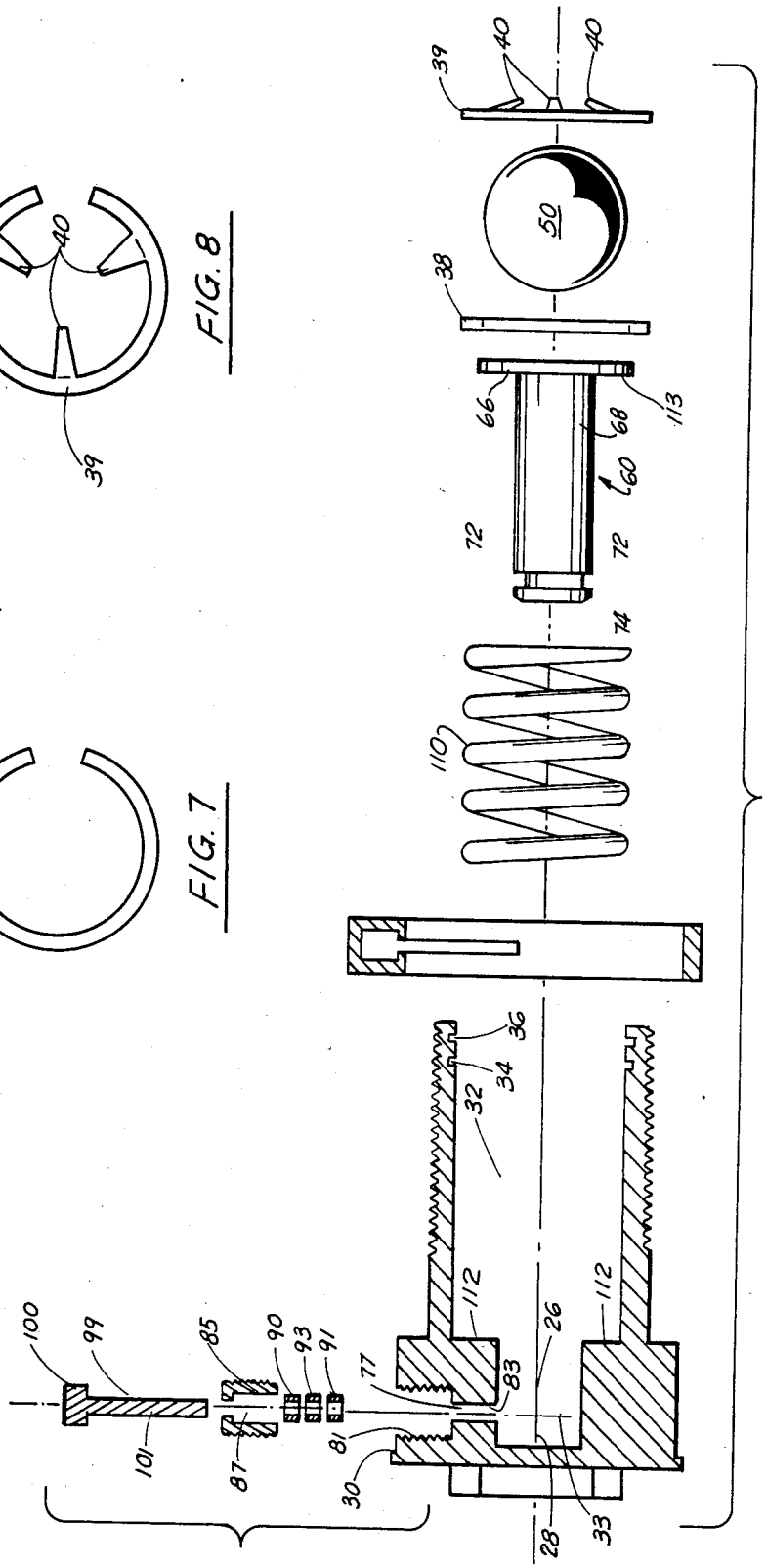
FIG. 6 is an exploded view of quick ball release mechanism of the apparatus of the present invention.

Referring to FIG. 3, there can be seen an isolated view of the subassembly 2 of the current invention 1, wherein it comprises a longitudinal bore 8, preferably along its central, vertical axis, and a transverse bore 14, provided through one side thereof, preferably, wherein the inner end 15 thereof is disposed in direct communication with longitudinal bore 8, for reasons which will hereinafter be clearly seen.

Referring now to FIG. 3, there can be seen the quick ball release bolt insert mechanism 20 of the present invention 1, in blown-apart, isolated view. Bolt insert mechanism 20 is there shown to comprise a head portion 22, preferably of the conventional hexagonally-shaped type, to thereby facilitate the application of torque wrenches thereto, and an inwardly extending stud portion 24, attached thereto, which is externally machine-threaded for mating with the internally provided machine-threads (not shown) within transverse bore 14 of sub 2. Further, stud portion 24 is provided with a preferably bipartite internal chamber 26 extending through its inner end 28 inwardly to a point substantially near its outer flanged end 30, although not therethrough. Bipartite internal chamber 26 of stud portion 24 preferably comprises a first, innermost, portion 32 and a second, outermost portion 33 communicating therewith, wherein first portion 32 is, preferably, relatively substantially longer and wider than second portion 33, for reasons which will hereinafter be clearly seen. Also, chamber 26 is preferably provided with a pair of spaced-apart annular recesses 34, 36 into which are securably inserted snap-ring 38 and retainer ring 39, respectively, wherein retainer ring 39 is preferably provided with a plurality of spaced-apart retainer fingers 40, made of steel or any other suitable material, hingedly attached thereto around the periphery thereof, for movement between open and closed positions wherein in said closed position, or non-operating mode, said fingers are disposed across chamber 26 in such a manner as to prevent movement of generally spherical valve ball 50 contained within first portion 32 of chamber 26 beyond inner end 27 thereof; and wherein in said open position, or operating mode, said fingers 40 are fully extended, thereby permitting the passage of ball 50 through outer end of chamber 26 and into longitudinal bore 8 of sub 2, for purposes which will hereinafter be fully discussed. Ball 50 is preferably made of steel, bronze, mylar, or any other suitably strong and durable material (able to withstand much stress and pressure) and must have a diameter at least just smaller than the protruding portion 55 of snap-ring 38, to thereby facilitate passage therethrough. Additionally, a plunger mechanism 60 is laterally mounted within chamber 26 for reciprocal movement between retracted and extended positions, wherein said plunger mechanism 60 preferably is a single, integral unit comprising a generally disc-shaped pusher plate 66 and a rearwardly extending generally cylindrical body portion 68 having at least one recess 72 (for reasons which will also be hereinafter seen) near the outer end 74 thereof. It is important to note that pusher plate 66 has a greater diameter than the inner diameter of snap-ring 38, thereby defining the innermost movement of plunger mechanism 60, which can be constructed of any suitably strong and durable material, such as steel or highly resistant plastic. Bolt insert mechanism 20 is further further provided with a bipartite transverse bore 77 through one side 79 thereof, wherein transverse bore 77 comprises an internally machine-threaded top chamber portion 81 and a narrower, lower channel 83, situated in direct communication on its top end with top portion 81 and at its bottom end with outermost portion 33 of chamber 26 of stud portion 24 of bolt insert mechanism 20. Connector sleeve insert 85, which has a longitudinal bore 87 provided therethrough, comprises externally machine-threads which are mated with the internally machine-threads of top portion 81 of transverse bore 77. A pair of O-rings 90, 91 and a preferably steel spacer ring 93 sandwiched therebetween are securably fitted within longitudinal bore 87 of connector sleeve insert 85. An activator pin 99, having a head portion 100 and a downwardly extending shank portion 101 and preferably constructed of steel or other suitably strong or durable material, is snugly, but slidably, journalled within O-rings 90, 91 and spacer ring 93, and lower channel 83 of transverse bore 77, and downwardly therethrough and into recess 72 of plunger mechanism 60, with which it cooperates, as will be hereinafter fully developed. A tension coil spring 110 is circumferentially mounted to body portion 68 of plunger mechanism 60 such that when said plunger mechanism 60 is in its retracted position, wherein it is held secure by shank portion 101 of activator pin 99 registering with recess 72 thereof, spring 110 is fully compressed between internal shoulder 112 of bolt insert mechanism 20 and the back-side 113 of pusher plate 66 of plunger mechanism 60. Further, an activator collar 120 is rotatably, circumferentially mounted to bolt insert mechanism 20 between outer flange 30 thereof and outer wall 124 of subassembly 2. Activator collar 120 comprises an arcuate outer sleeve portion 128 which comprises an internal channel 130 into which head portion 100 of activator pin 99 is inserted, via entry orifice 132, for travelling movement back and forth along the progressively sloped floor 134 thereof. Sleeve portion 128 further comprises a generally L-shaped channel 140 into which a preferably metal-twisted cable 144 is securely fastened, wherein cable 144 is of sufficient length to reach downwardly to the floor 150 of oil rig 155, as can be seen in FIG. 1.

In operation, the device 1 of the present invention works in the following simple manner, reference being had to FIGS. 1 and 3:

(1) Whenever oil rig personnel detect/sense excessive gas (or any other) pressure emanating from downhole (i.e. from within the well bore 150 being drilled—see FIG. 1), which poses a potentially very hazardous situation, the device 1 of the present invention should be employed to thwart this preceived threat;

(2) At this point, cable 144 can be pulled downwardly with approximately 100 to 150 pounds of force, in the preferred embodiment, thereby transmitting an equivalent rotational/torquing force to activator collar 120, thereby causing head portion 100 of activator pin 99 to travel along progressively sloped floor 134 of channel 130 of sleeve portion 120, thereby causing activator pin 99 to be gradually/progressively lifted upwardly, thereby eventually causing (the exact amount of time depends upon the dimensions of the various components of the device 1 and the amount of force applied) shank portion 101 to be removed from recess 72 of plunger mechanism 60, thereby ultimately causing coil spring 110 to expand against and thus transmit a force equal to its stored force in its normally (i.e. before actuation of the device 1) compressed state against the back-side 113 of pusher plate 66 and plunger 60, thereby causing pusher plate 66 to forcibly push ball valve 50 against retainer fingers 40, thereby forcing said fingers 40 into their fully extended position or operating mode, thereby allowing the ball 50 to pass through inner end 27 of chamber 26 and into longitudinal bore 8 of sub 2, as can be best seen in FIG. 2;

(3) The gas pressure emanating from some subterranean source 155 being drilled by drill bit 157 which is attached to the bottommost drill pipe 165 of drill pipe string 159, which is comprised of many segments or individual joints of drill pipe 158, travels upwardly through the bore 160 thereof—the uppermost joint of drill pipe 162 is fluidly connected to kelly 6 of oil rig 155, whereby said gas pressure thus travels upwardly through continuous fluid passage 12, whereby said gas pressure thus exerts upwardly directed force against ball 50, thereby ultimately forcing said ball 50 upwardly into fluidly sealing, seating engagement with valve seat 170, which is preferably fixably attached, for example welded to, the inner walls 175 of longitudinal bore 8 of sub 2, said valve seat 170 comprising a generally cylindrical, preferably steel structure having a plurality of axial slots provided vertically therethrough around the periphery of valve seat 170 formed by the beveled upper portion of valve seat 170, the upper portion being preferably made of a high strength, non-corrosive, wear-and-tear resistant material, such as tungsten carbide steel, to thereby prevent wear, tear, and corrosion of valve seat 170, to thereby ensure proper fluid sealing engagement of ball 50 therewith;

(4) The fluidly sealing, seating engagement of ball 50 with valve seat 170 prevents any further upward flow of said gas pressure, thereby substantially deferring a blowout from occurring, said device 1 of the present invention thus functioning as a blowout preventor;

(5) In order to neutralize and overcome said downhole gas pressure, fluid or mud is circulated from kelly cock valve 4 through axial slots valve seat 170, and downwardly through continuous fluid flow passage 12, bore 160 of drill pipe string 159, and thence into said subterranean source 155 from whence said gas pressure emanates, in the conventional manner widely known in the oil and gas industry, thus eliminating the threat of an oil rig blowout;

(6) There is also provided a ball securing system 172 mounted downstream of valve seat 170 as best shown in FIG. 2.

Assembly 174 comprises a general cylindrical structure 177 having a plurality of axial slots 180 provided vertically therethrough around the periphery of ball seat 172, formed by the beveled bottom portion 173 of structure 177.

When mud is forced downhole from Kelly Cock Valve 4 through axial slots 180, valve 50 travels downwardly into setting engagement with ball seat 172, while slots 180 allow a non-obstructed flow of mud around ball 50 down central bore 8 in sub 2. At the same time ball 50 is securedly held within assembly 174.

(7) Now that the blowout threat has been quelled, a pipe wrench (not shown) or any other suitable tool (not shown) can be applied to head portion 22 of bolt insert mechanism 20 to unscrew it from transverse bore 14 of sub 2, thereby facilitating re-loading thereof in the obvious manner for further re-use.

In an alternative embodiment, the present invention, as shown in FIG. 2, features a second bolt insert mechanism 200, suitably identical to bolt insert mechanism 20 of above-described in every regard except insofar as the ball contained therein, securably screwed into second transverse bore 202 preferably provided through sub 2, through the side thereof opposite transverse bore 14, said second transverse bore communicating on its inner end 204 with longitudinal bore 8 of sub 2. Ball 220 of bolt insert mechanism 200 is smaller in diameter than longitudinal bore 8 of sub 2 thereby, upon actuation of plunger mechanism 260 in the same manner as with plunger 60, facilitating the injection of ball 220 into longitudinal bore 8 of sub 2 and the subsequent downward movement of ball 220 through bore of drill pipe string 159, whereby ball 220 will ultimately activate fishing/downhole retriever tool disposed within the bore of drill pipe string 159 thereby facilitating the retrieval of "junk" (i.e. broken drilling bits, excess rock shavings which may impede drilling, lost tools which may have been accidentally dropped from oil rig 155 downhole, etc.) from downhole, in a manner widely known in the relevant art.

While a limited number of specific embodiments of the present invention are shown and described somewhat in detail herein, the same are merely illustrative of the entire inventive concept and principles herein involved, and many other forms can be suitably employed without departing from the spirit and scope of the present invention.

What is claimed is:

1. A quick ball release blowout preventor apparatus mounted above a kelly for preventing oil and gas well blowouts occasioned by excessive downhole pressure, comprising:

(a) a sub-assembly fluidly connected on its top end to a fluid flow passageway of a kelly cock valve and on its bottom end to a fluid flow passageway of a drillstring intermediate the kelly, wherein said sub-assembly is provided with a longitudinal bore therethrough and a transverse bore through one side thereof, said transverse bore directly communicating with said longitudinal bore at its inner end, and wherein further, said sub-assembly comprises a valve seat disposed within said longitudinal bore and a ball securing means positioned downstream of said valve seat in the longitudinal bore;

(b) a ball valve release mechanism mounted substantially within the transverse bore, comprising a head portion and a stud portion extending inwardly into the transverse bore from said head portion, wherein said stud portion comprises:

i. an internal chamber having an inner end disposed in direct communication with said longitudinal bore of said sub-assembly;

ii. a ball mounted within said internal chamber;

iii. a ball retainer means;

iv. a plunger means mounted within said chamber and engaging the ball on the opposite side from said ball retainer means;

v. an actuator means disposed in functional relationship to said plunger mechanism actuatable by external means to selectively actuate said plunger means between an operating and non-operating mode, said actuator means comprising an actuator pin having a head portion and a downwardly extending shank portion, a collar circumferentially mounted onto the stud portion of the ball valve release mechanism adjacent the head portion thereof; and vi a means for transmitting rotational force to the actuator collar, said means for transmitting rotational force comprising a cable attached to said actuator collar and extending downwardly therefrom to enable personnel situated on an oilrig floor to exert a downward pull thereto, to thereby impart rotational force to said collar and actuate the plunger.

2. The apparatus of claim 1, wherein the ball securing means positioned downstream of said valve seat comprises a ball seat fixedly attached to inner wall of the sub assembly, the ball seat having means to allow a fluid to pass therethrough and to prevent the ball from being forced downhole by a downward fluid flow.

3. The apparatus of claim 1, wherein it further comprises a second transverse bore in the opposite side of said sub assembly for receiving a second substantially identical ball valve release mechanism, characterized in that the ball mounted within the internal chamber of the second ball valve release mechanism is of a diameter smaller than that of an opening in the ball securing means, allowing the ball of the second ball valve release mechanism to pass downhole and actuate a tool retrieving mechanism positioned therein.

4. The apparatus of claim 1, wherein the actuator collar is being provided with an actuated outer sleeve having an internal channel with a progressively sloped floor for receiving the head portion of the actuator pin and allowing it to travel along the channel, thereby relesing the shank portion of the actuator pin for engagement within the recess of the plunger body.

* * * * *